US008581822B2

(12) United States Patent
Chuang et al.

(10) Patent No.: US 8,581,822 B2
(45) Date of Patent: Nov. 12, 2013

(54) DOUBLE-GATE LIQUID CRYSTAL DISPLAY DEVICE WHICH ADJUSTS MAIN-CHARGE TIME AND PRECHARGE TIME ACCORDING TO DATA POLARITIES AND RELATED DRIVING METHOD

(75) Inventors: Hui-Ping Chuang, Taoyuan County (TW); Yi-Jui Huang, Taipei County (TW); Tsan-Ming Hsieh, Taoyuan County (TW); Chun-Chieh Yu, Taipei (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 784 days.

(21) Appl. No.: 12/824,240

(22) Filed: Jun. 28, 2010

(65) Prior Publication Data

US 2011/0221729 A1 Sep. 15, 2011

(30) Foreign Application Priority Data

Mar. 11, 2010 (TW) ..... 99107134 A

(51) Int. Cl.
*G09G 3/36* (2006.01)

(52) U.S. Cl.
USPC ..... 345/94

(58) Field of Classification Search
USPC ..... 345/87, 90, 94, 95, 98, 99, 55, 84, 38, 345/39, 50
See application file for complete search history.

(56) References Cited

U.S. PATENT DOCUMENTS

| | | | | |
|---|---|---|---|---|
| 2003/0043104 | A1 | 3/2003 | Lee | |
| 2006/0284815 | A1 * | 12/2006 | Kwon et al. | 345/98 |
| 2007/0097057 | A1 * | 5/2007 | Shin | 345/98 |
| 2007/0183218 | A1 | 8/2007 | Lee | |
| 2011/0221729 | A1 * | 9/2011 | Chuang et al. | 345/211 |

FOREIGN PATENT DOCUMENTS

| | | |
|---|---|---|
| CN | 1407536 A | 4/2003 |
| CN | 1691101 A | 11/2005 |
| TW | 491959 | 6/2002 |
| TW | 200926125 | 6/2009 |
| TW | 201005722 | 2/2010 |

* cited by examiner

*Primary Examiner* — Chanh Nguyen
*Assistant Examiner* — Ram Mistry
(74) *Attorney, Agent, or Firm* — Winston Hsu; Scott Margo

(57) ABSTRACT

A method for driving a liquid crystal display device provides sufficient charge time for a pixel unit by adjusting a main-charge time and a precharge time of the pixel unit according to the polarities of data driving signals applied during a main-charge period and a precharge period. Meanwhile, the method controls a write period during which a data driving signal is written into a pixel unit, so that each pixel unit can be equally charged.

5 Claims, 4 Drawing Sheets

DOUBLE-GATE LIQUID CRYSTAL DISPLAY DEVICE WHICH ADJUSTS MAIN-CHARGE TIME AND PRECHARGE TIME ACCORDING TO DATA POLARITIES AND RELATED DRIVING METHOD

BACKGROUND OF THE INVENTION

1. Field of the Invention

The present invention is related to a double-gate liquid crystal display device and related driving method, and more particularly, to a double-gate liquid crystal display device and related driving method which improve display quality.

2. Description of the Prior Art

Liquid crystal display (LCD) devices with thin appearance have gradually replace traditional bulky cathode ray tube (CRT) displays and been widely used in various electronic products, such as notebook computers, personal digital assistants (PDAs), flat panel TVs, or mobile phones. In a typical LCD device, a timing controller is used for generating various control signals, based on which a source driver and a gate driver scan the pixels on the panel for displaying images. The LCD device is driven according to pixel arrangement. For the same resolution, an LCD panel having double-gate pixel arrangement requires twice the number of gate lines (more gate driving chips) and half the number of data lines (fewer source driving chips) when compared to an LCD panel having single-gate pixel arrangement. Since gate driving chips are less expensive and consume less power, double-gate pixel arrangement may reduce manufacturing costs and power consumption.

FIG. 1 is a diagram illustrating a prior art LCD device 100 having double-gate pixel arrangement. The LCD device 100 includes an LCD panel 110, a source driver 120, a gate driver 130, and a timing controller 140. A plurality of data lines $DL_1$-$DL_m$, a plurality of gate lines $GL_1$-$GL_n$, and a pixel matrix are disposed on the LCD panel 110. The pixel matrix includes a plurality of pixel units $P_L$ and $P_R$ each having a thin film transistor (TFT) switch, a liquid crystal capacitor $C_{LC}$ and a storage capacitor $C_{ST}$, and respectively coupled to a corresponding data line, a corresponding gate line and a common voltage $V_{COM}$. In the LCD device 100, two adjacent columns of pixel units $P_L$ and $P_R$ are coupled to the same data line, wherein the odd-numbered columns of pixel units $P_L$ are coupled to the odd-numbered gate lines $GL_1, GL_3, \ldots, GL_{n-1}$ and the even-numbered columns of pixel units $P_R$ are coupled to the even-numbered gate lines $GL_2, GL_4, \ldots, GL_n$.

The timing controller 140 is configured to generate control signals for operating the source driver 120 and the gate driver 130, such as a latch pulse signal TP and an image signal DATA. According to the latch pulse signal TP, the gate driver 130 sequentially outputs the gate driving signals $SG_1$-$SG_n$ to the corresponding gate lines $GL_1$-$GL_n$. According to the image signal DATA, the source driver 120 outputs the data driving signals $SD_1$-$SD_m$ associated with display images to the corresponding data lines $DL_1$-$DL_m$, thereby charging the liquid crystal capacitors $C_{LC}$ and the storage capacitors $C_{ST}$ of the corresponding columns of pixel units.

FIG. 2 is a timing diagram illustrating the operation of the prior LCD device 100. FIG. 2 shows the latch pulse TP, the gate driving signals $SG_1$-$SG_4$, and the pixel voltages $V_{+-}$, $V_{--}$, $V_{-+}$, $V_{++}$. The latch pulse TP is a pulse signal with a constant trigger frequency so that each pixel unit has a constant charge time $T_{ON}$ during each period. The pixel voltages $V_{+-}$, $V_{--}$, $V_{-+}$, $V_{++}$ correspond to the voltage levels of two adjacent pixel units $P_L$ and $P_R$ in a certain row of pixel units which are coupled to the same data line. Assuming that the polarities of the data driving signals during the periods T1-T5 are respectively positive, negative, negative, positive and positive (as indicated by "+" and "−" in FIG. 2), the two rows of pixel units coupled to the gate lines $GL_1$-$GL_4$ are used for illustration. During the period T1, the gate driving signal $SG_1$ is at enable level (high level), and the positive data driving signal precharges the odd-numbered columns of pixel units $P_L$ in the first row of pixel units via the turned-on TFT switch; during the period T2, the gate driving signals $SG_1$ and $SG_2$ are both at enable level, and the negative data driving signal main-charges the odd-numbered columns of pixel units $P_L$ and precharges the even-numbered columns of pixel units $P_R$ in the first row of pixel units via the turned-on TFT switch; during the period T3, the gate driving signals $SG_2$ and $SG_3$ are both at enable level, and the negative data driving signal main-charges the even-numbered columns of pixel units $P_R$ in the first row of pixel units and precharges the odd-numbered columns of pixel units $P_L$ in the second row of pixel units via the turned-on TFT switch; during the period T4, the gate driving signals $SG_3$ and $SG_4$ are both at enable level, and the positive data driving signal main-charges the odd-numbered columns of pixel units $P_L$ and precharges the even-numbered columns of pixel units $P_R$ in the second row of pixel units via the turned-on TFT switch; during the period T5, the gate driving signal $SG_4$ is at enable level, and the positive data driving signal charges the even-numbered columns of pixel units $P_R$ in the second row of pixel units via the turned-on TFT switch.

In other words, the odd-numbered columns of pixel units $P_L$ in the first row of pixel units, whose voltage level may be represented by $V_{+-}$, receive positive data driving signals during the corresponding precharge period T1 and receive negative data driving signals during the corresponding main-charge period T2; the even-numbered columns of pixel units $P_R$ in the first row of pixel units, whose voltage level may be represented by $V_{--}$, receive negative data driving signals both during the corresponding precharge period T2 and the corresponding main-charge period T3; the odd-numbered columns of pixel units $P_L$ in the second row of pixel units, whose voltage level may be represented by $V_{-+}$, receive negative data driving signals during the corresponding precharge period T3 and receive positive data driving signals during the corresponding main-charge period T4; the even-numbered columns of pixel units $P_R$ in the second row of pixel units, whose voltage level may be represented by $V_{++}$, receive positive data driving signals during the corresponding precharge period T4 and the corresponding main-charge period T5.

If a pixel unit receives data driving signals having the same polarity during its main-charge and precharge periods, the pixel unit has sufficient time to reach its predetermined level (as illustrated by $V_{++}$ or $V_{--}$). In this case, the amount of charges written into the pixel unit is represented by the striped region marked by A2 and A4 in FIG. 2. If a pixel unit receives data driving signals having opposite polarities during its main charge and precharge periods, it takes longer for the pixel unit to reach its predetermined level since its voltage level needs to be reversed (as illustrated by $V_{+-}$ or $V_{-+}$). In this case, the amount of charges written into the pixel unit is represented by the striped region marked by A1 and A3 in FIG. 2. As illustrated in FIG. 2, for displaying images having the same gray-scale value, certain pixel units may provide downgraded display quality due to insufficient charge time (the area of A1/A3 is smaller than that of A2/A4).

SUMMARY OF THE INVENTION

The present invention provides a method for driving a double-gate liquid crystal display device. The method includes precharging a first pixel unit by outputting a first data driving signal during a first period; main-charging the first pixel unit and precharging a second pixel unit by outputting a second data driving signal during a second period subsequent to the first period, wherein the first pixel unit is coupled to a data line and a first gate line and the second pixel unit is coupled to the data line and a second gate line; main-charging the second pixel unit by outputting a third data driving signal during a third period subsequent to the second period; adjusting a precharge time of the first pixel unit during the first period and a main-charge time of the first pixel unit during the second period according to a polarity of the first data signal driving signal and a polarity of the second data signal driving signal; and adjusting a first write period during which the second data driving signal is written into the first pixel unit and a second write period during which the third data driving signal is written into the second pixel unit, so that the main-charge time of the first pixel unit during the second period is substantially equal to the main-charge time of the second pixel unit during the third period.

The present invention further provides a liquid crystal display device with double-gate pixel arrangement. The liquid crystal display device includes a first gate line for transmitting a first gate driving signal; a second gate line disposed adjacent and parallel to the first gate line for transmitting a second gate driving signal; a data line disposed perpendicular to the first gate line and the second gate line for transmitting a first data driving signal and a second data driving signal; a first pixel unit coupled to the data line and the first gate line for displaying images during a first period according to the first gate driving signal and the first data driving signal during a first period; a second pixel unit coupled to the data line and the second gate line for displaying images during a second period subsequent to the first period according to the second gate driving signal and the second data driving signal; a gate driver configured to output the first gate driving signal and the second gate driving signal according to a latch pulse signal and an output enable signal; a source driver configured to output the first data driving signal and the second data driving signal according to an image signal; and a timing controller. The timing controller includes a judging unit configured to determine if the first pixel unit and the second pixel unit have sufficient charge time according to a polarity of the first data driving signal and a polarity of the second data driving signal; and an adjusting circuit configured to adjust the latch pulse signal and the output enable signal according to a determining result of the judging unit so that an amount of charges written into the first pixel unit during the first period is substantially equal to an amount of charges written into the second pixel unit during the second period.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
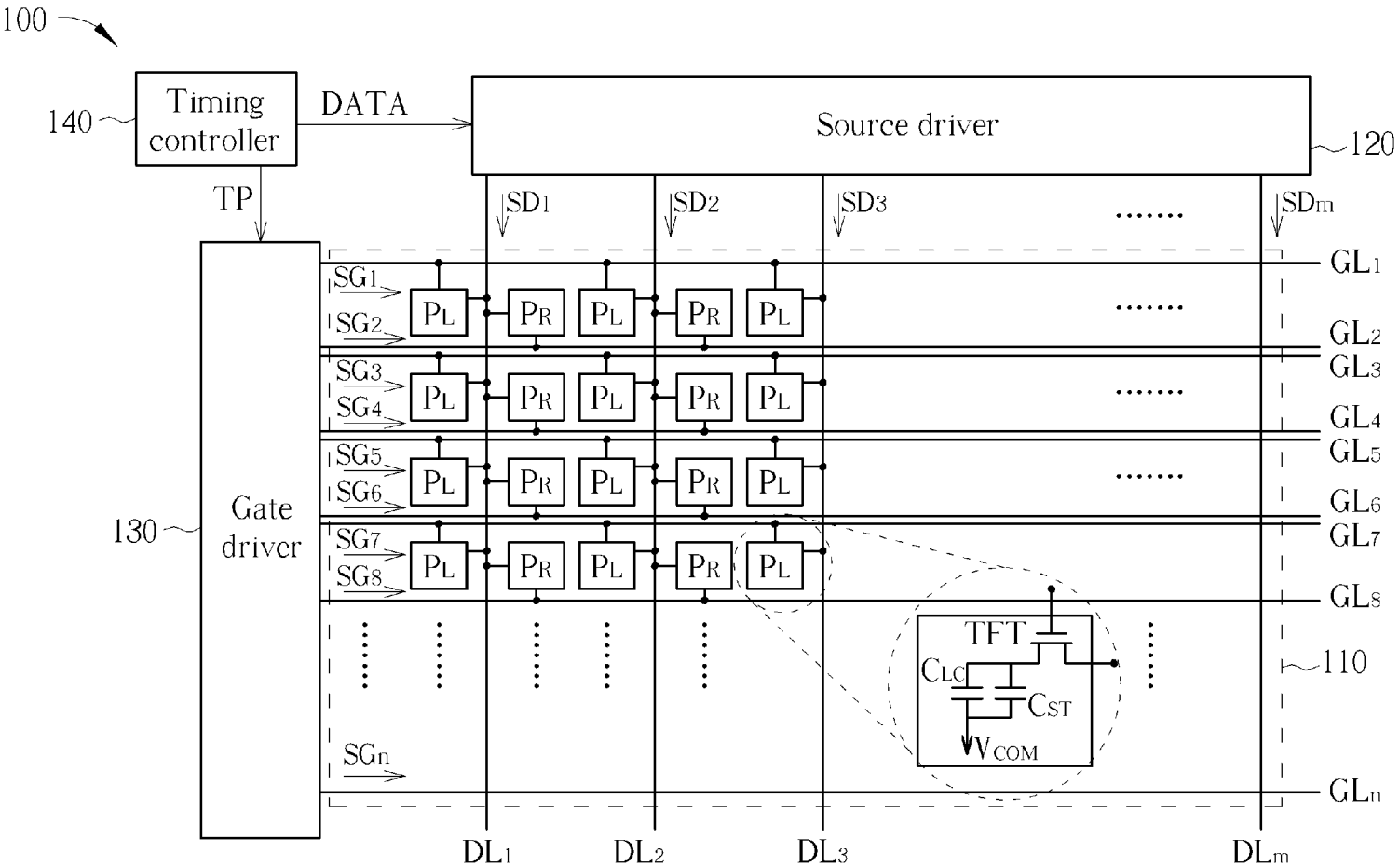
FIG. 1 PRIOR ART
FIG. 1 is a diagram illustrating a prior art LCD device having double-gate pixel arrangement.
Figure 2:
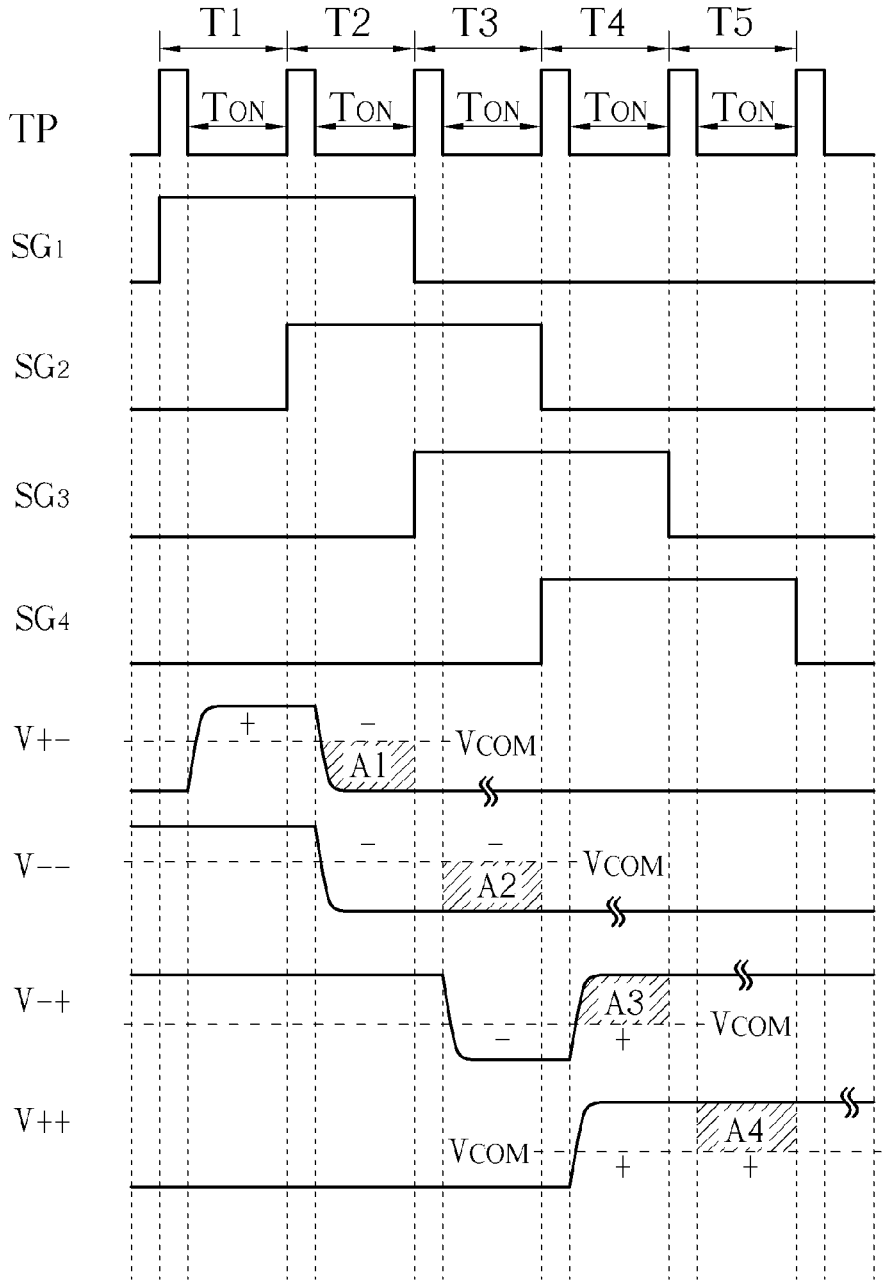
FIG. 2 PRIOR ART
FIG. 2 is a timing diagram illustrating the operation of the prior LCD device.
Figure 3:
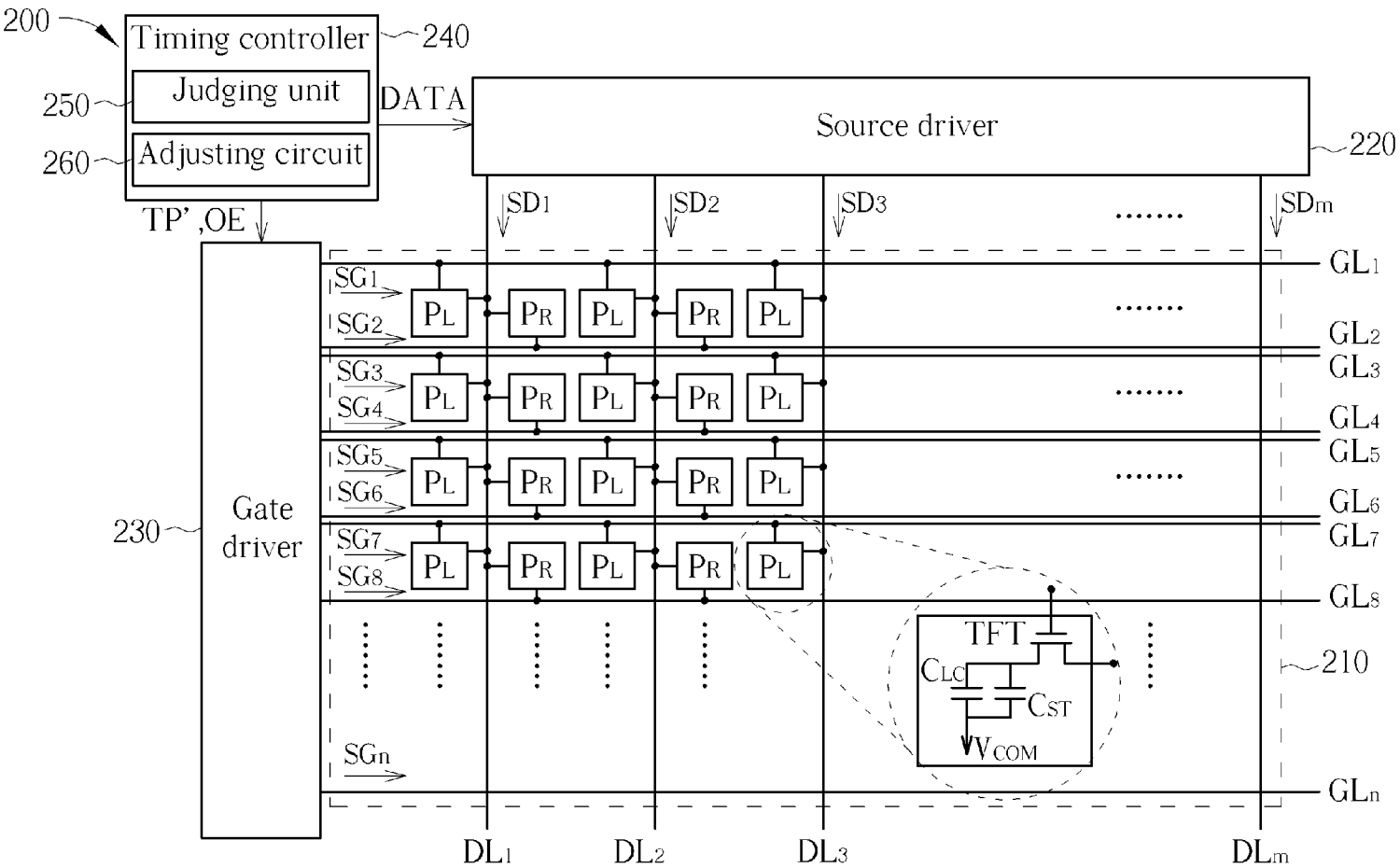
FIG. 3 is a diagram illustrating an LCD device having double-gate pixel arrangement according to the present invention.

FIG. 3 is a diagram illustrating an LCD device 200 having double-gate pixel arrangement according to the present invention. The LCD device 200 includes an LCD panel 210, a source driver 220, a gate driver 230, and a timing controller 240. A plurality of data lines $DL_1$-$DL_m$, a plurality of gate lines $GL_1$-$GL_n$, and a pixel matrix are disposed on the LCD panel 210. The pixel matrix includes a plurality of pixel units $P_L$ and $P_R$ each having a TFT switch, a liquid crystal capacitor $C_{LC}$ and a storage capacitor $C_{ST}$, and respectively coupled to a corresponding data line, a corresponding gate line and a common voltage VCOM. In the LCD device 200, two adjacent columns of pixel units $P_L$ and $P_R$ are coupled to the same data line, wherein the odd-numbered columns of pixel units $P_L$ disposed on the left side of the data line are coupled to the corresponding odd-numbered gate lines $GL_1, GL_3, \ldots, GL_{n-1}$ and the even-numbered columns of pixel units $P_R$ disposed on the right side of the data line are coupled to the corresponding even-numbered gate lines $GL_2, GL_4, \ldots, GL_n$ (assuming n is an even integer).

The timing controller 240, including a judging unit 250 and an adjusting circuit 260, is configured to generate control signals for operating the source driver 220 and the gate driver 230, such as a latch pulse signal TP', an output enable signal OE and an image signal DATA. According to the latch pulse signal TP' and the output enable signal OE, the gate driver 230 sequentially scans the gate lines $GL_1$-$GL_n$. According to the image signal DATA, the source driver 220 outputs the data driving signals $SD_1$-$SD_m$ associated with display images to the corresponding data lines $DL_1$-$DL_m$, thereby charging the liquid crystal capacitors $C_{LC}$ and the storage capacitors $C_{ST}$ of the corresponding columns of pixel units. According to display images and driving methods, the data driving signals applied to the pixel units during the corresponding main-charge periods and precharge periods may have different polarities. The judging unit 250 is configured to determine if the pixel units have sufficient charge time according to the display images and the adopted driving method. The adjusting circuit 260 is configured to adjust the latch pulse signal TP' and the output enable signal OE according to the determining result of the judging unit 250 so that the same amount of charges written into each pixel unit may be substantially the same.

Figure 4:
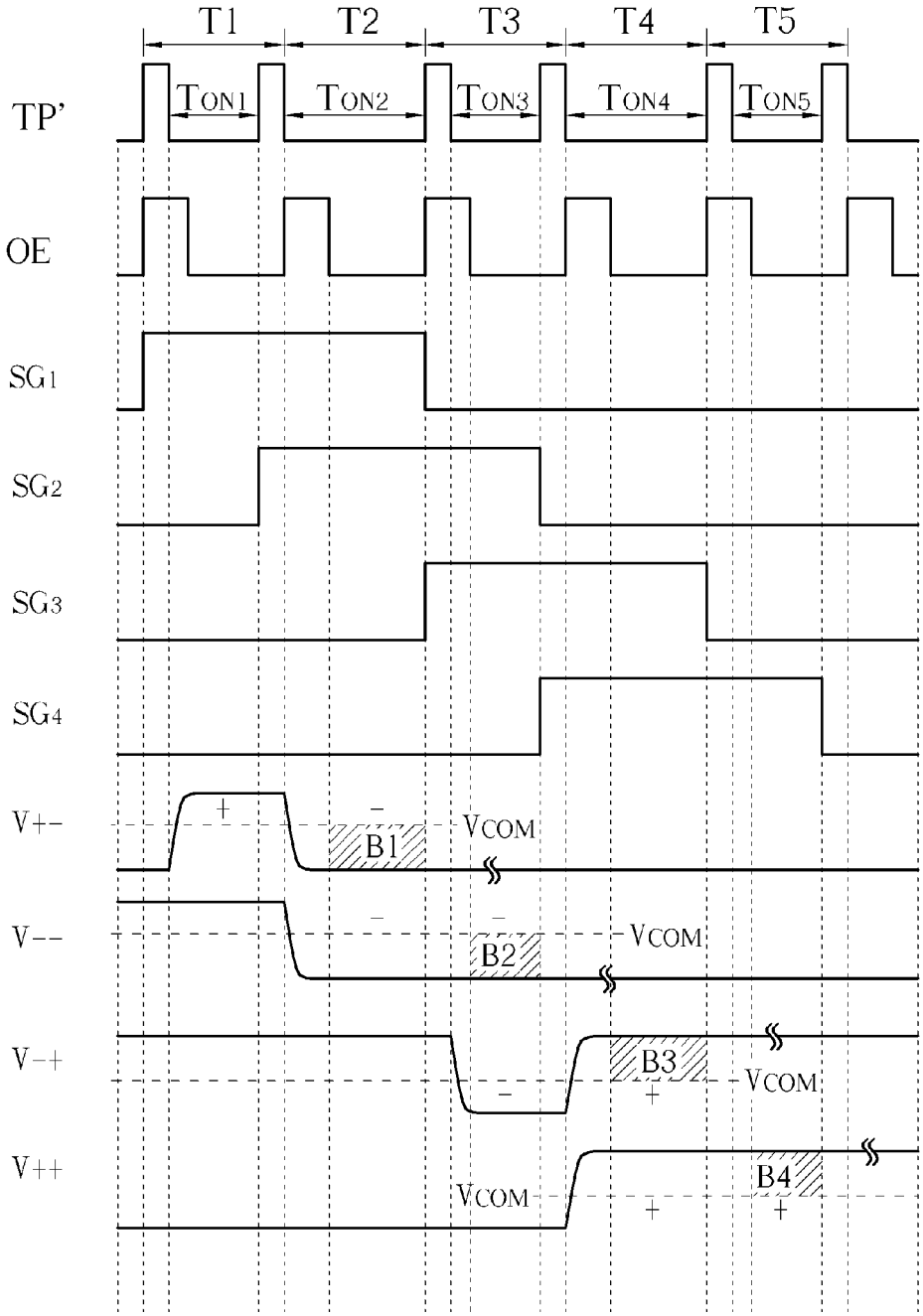
FIG. 4 is a timing diagram illustrating the operation of the LCD device according to the present invention.

FIG. 4 is a timing diagram illustrating the operation of the LCD device 200 according to the present invention. FIG. 4 shows the latch pulse TP', the output enable signal OE, the gate driving signals SG1-SG4, and the pixel voltages V+−, V−−, V−+, V++. The adjusting circuit 260 is configured to modulate the trigger frequency of the latch pulse TP' so that each pixel unit may have different charge time TON1-TON5 during each period. The pixel voltages V+−, V−−, V−+, V++ correspond to the voltage levels of two adjacent pixel units $P_L$ and $P_R$ in a certain row of pixel units which are coupled to the same data line. Assuming that the polarities of the data driving signals during the periods T1-T5 are respectively positive, negative, negative, positive and positive, the two rows of pixel units coupled to the gate lines $GL_1$-$GL_4$ are used for illustration. During the period T1, the gate driving signal $SG_1$ is at enable level (high level), and the positive data driving signal precharges the odd-numbered columns of pixel units $P_L$ in the first row of pixel units via the turned-on TFT switch; during the period T2, the gate driving signals $SG_1$ and $SG_2$ are both at enable level, and the negative data driving signal main-charges the odd-numbered columns of pixel units $P_L$ and precharges the even-numbered columns of pixel units $P_R$ in the first row of pixel units via the turned-on TFT switch; during the period T3, the gate driving signals $SG_2$ and $SG_3$ are both at enable level, and the negative data driving signal main-charges the even-numbered columns of pixel units $P_R$ in the first row of pixel units and precharges the odd-numbered columns of pixel units $P_L$ in the second row of pixel units via the turned-on TFT switch; during the period T4, the gate driving signals $SG_3$ and $SG_4$ are both at enable level, and the positive data driving signal main-charges the odd-numbered columns of pixel units $P_L$ and precharges the even-numbered columns of pixel units $P_R$ in the second row of pixel units via the turned-on TFT switch; during the period T5, the gate driving signal $SG_4$ is at enable level, and the positive data driving signal main-charges the even-numbered columns of pixel units $P_R$ in the second row of pixel units via the turned-on TFT switch.

The odd-numbered columns of pixel units $P_L$ in the first row of pixel units, whose voltage level may be represented by V+−, receive positive data driving signals during the corresponding precharge period T1 and receive negative data driving signals during the corresponding main-charge period T2. When the judging unit 250 determines that the data driving signals have opposite polarities during the corresponding main-charge period and the corresponding precharge period, the adjusting circuit 260 modulates the trigger frequency of the latch pulse signal TP' so that the charge time $T_{ON1}$ of the pixel units during the precharge period T1 may be shorter than the charge time $T_{ON2}$ during the main-charge period T2, thereby shortening the time required for reversing voltage level. Meanwhile, the adjusting circuit 260 also adjusts the amount of charges B1 written into the pixel units by outputting the output enable signal OE.

The even-numbered columns of pixel units $P_R$ in the first row of pixel units, whose voltage level may be represented by V−−, receive negative data driving signals both during the corresponding precharge period T2 and the corresponding main-charge period T3. When the judging unit 250 determines that the data driving signals have the same polarity during the corresponding main-charge period and the corresponding precharge period, the adjusting circuit 260 modulates the trigger frequency of the latch pulse signal TP' so that the charge time $T_{ON2}$ of the pixel units during the precharge period T2 may be longer than the charge time $T_{ON3}$ during the main charge period T3. Meanwhile, the adjusting circuit 260 also adjusts the amount of charges B2 written into the pixel units by outputting the output enable signal OE.

The odd-numbered columns of pixel units $P_L$ in the second row of pixel units, whose voltage level may be represented by V−+, receive negative data driving signals during the corresponding precharge period T3 and receive positive data driving signals during the corresponding main-charge period T4. When the judging unit 250 determines that the data driving signals have opposite polarities during the corresponding main-charge period and the corresponding precharge period, the adjusting circuit 260 modulates the trigger frequency of the latch pulse signal TP' so that the charge time $T_{ON3}$ of the pixel units during the precharge period T3 may be shorter than the charge time $T_{ON4}$ during the main-charge period T4, thereby shortening the time required for reversing voltage level. Meanwhile, the adjusting circuit 260 also adjusts the amount of charges B3 written into the pixel units by outputting the output enable signal OE.

The even-numbered columns of pixel units $P_R$ in the second row of pixel units, whose voltage level may be represented by V++, receive positive data driving signals both during the corresponding precharge period T4 and the corresponding main-charge period T5. When the judging unit 250 determines that the data driving signals have the same polarity during the corresponding main-charge period and the corresponding precharge period, the adjusting circuit 260 modulates the trigger frequency of the latch pulse signal TP' so that the charge time $T_{ON4}$ of the pixel units during the precharge period T4 may be longer than the charge time $T_{ON5}$ during the main charge period T5. Meanwhile, the adjusting circuit 260 also adjusts the amount of charges B4 written into the pixel units by outputting the output enable signal OE.

As illustrated in FIG. 4, the present invention adjusts the main-charge time and the precharge time of pixel units according to the adopted driving method. Therefore, the pixel units have sufficient time to reach predetermined voltage levels regardless of the polarities of the data driving signals which are applied during the main-charge period and the precharge period. Meanwhile, the output enable signal OE is used in the present invention for controlling the write period during which the data driving signals are written into the corresponding pixel units during the main-charge periods (such as how long the output enable signal OE is at low level). Therefore, the amount of charges written into each pixel unit may be substantially the same for improving display quality.

Those skilled in the art will readily observe that numerous modifications and alterations of the device and method may be made while retaining the teachings of the invention.

What is claimed is:

1. A method for driving a double-gate liquid crystal display device, comprising:

precharging a first pixel unit by outputting a first data driving signal during a first period according to a first gate driving signal;

main-charging the first pixel unit and precharging a second pixel unit by outputting a second data driving signal during a second period subsequent to the first period according the first gate driving signal and a second gate driving signal, wherein the first pixel unit is coupled to a data line and a first gate line and the second pixel unit is coupled to the data line and a second gate line;

main-charging the second pixel unit by outputting a third data driving signal during a third period subsequent to the second period according the second gate driving signal and a third gate driving signal;

reducing a precharge time of the first pixel unit during the first period and increasing a main-charge time of the first pixel unit during the second period when the first data driving signal and the second data driving signal have opposite polarities, or increasing the precharge time of the first pixel unit during the first period and reducing the main-charge time of the first pixel unit during the second period when the first data driving signal and the second data driving signal have a same polarity; and adjusting a first write period during which the second data driving signal is written into the first pixel unit during the second period and a second write period during which the third data driving signal is written into the second pixel unit during the third period, so that an amount of charges written into the first pixel unit during the second period is substantially equal to an amount of charges written into the second pixel unit during the third period; wherein:

the first gate driving signal is at an enable level, the second gate driving signal is not at the enable level, and the third gate driving signal is not at the enable level during the first period;

the first gate driving signal is at the enable level, the second gate driving signal is at the enable level, and the third gate driving signal is not at the enable level during the second period;

the first gate driving signal is not at the enable level, the second gate driving signal is at the enable level, and the third gate driving signal is at the enable level during the third period; and pulse widths of the first gate driving signal, the second gate driving signal and the third gate driving signal are of a same length.

2. The method of claim 1, further comprising:

precharging a third pixel unit by outputting the second data driving signal during the third period, wherein the third pixel unit is coupled to the data line and a third gate line.

3. The method of claim 2, further comprising:

adjusting a precharge time of the second pixel unit during the second period and a main-charge time of the second pixel unit during the third period according to the polarity of the second data signal driving signal and a polarity of the third data signal driving signal.

4. A liquid crystal display device with double-gate pixel arrangement, comprising:

a first gate line for transmitting a first gate driving signal;

a second gate line disposed adjacent and parallel to the first gate line for transmitting a second gate driving signal;

a data line disposed perpendicular to the first gate line and the second gate line for transmitting a first data driving signal and a second data driving signal;

a first pixel unit coupled to the data line and the first gate line for displaying images during a first period according to the first gate driving signal and the first data driving signal during a first period;

a second pixel unit coupled to the data line and the second gate line for displaying images during a second period subsequent to the first period according to the second gate driving signal and the second data driving signal;

a gate driver configured to output the first gate driving signal and the second gate driving signal according to a latch pulse signal and an output enable signal, wherein pulse widths of the first gate driving signal and the second gate driving signal are of a same length;

a source driver configured to output the first data driving signal and the second data driving signal according to an image signal;

a timing controller comprising:

a judging unit configured to determine if the first pixel unit and the second pixel unit have sufficient charge time according to a polarity of the first data driving signal and a polarity of the second data driving signal; and an adjusting circuit configured to adjust the latch pulse signal and the output enable signal for adjusting a precharge time of the first pixel unit during the first period and a main-charge time of the first pixel unit during the second period according to a determining result of the judging unit so that an amount of charges written into the first pixel unit during the first period is substantially equal to an amount of charges written into the second pixel unit during the second period, wherein:

the precharge time of the first pixel unit during the first period is reduced and the main-charge time of the first pixel unit during the second period is increased when the first data driving signal and the second data driving signal have opposite polarities; or the precharge time of the first pixel unit during the first period is increased and the main-charge time of the first pixel unit during the second period is reduced when the first data driving signal and the second data driving signal have a same polarity.

5. The liquid crystal display device of claim 4, wherein:

the first pixel unit includes:

a first thin film transistor switch having:

a control end coupled to the first gate line;

a first end coupled to the data line: and a second end;

a first liquid crystal capacitor coupled between the second end of the first thin film transistor switch and a common voltage; and a first storage capacitor coupled between the second end of the first thin film transistor switch and the common voltage; and the second pixel unit includes:

a second thin film transistor switch having:

a control end coupled to the second gate line;

a first end coupled to the data line: and a second end;

a second liquid crystal capacitor coupled between the second end of the second thin film transistor switch and the common voltage; and a second storage capacitor coupled between the second end of the second thin film transistor switch and the common voltage.

* * * * *